United States Patent [19]

Gosselin et al.

[11] Patent Number: 5,022,101

[45] Date of Patent: Jun. 11, 1991

[54] THERMAL COVER FOR A SPA

[76] Inventors: Jeffrey E. Gosselin; Lisa A. Gosselin, both of 20 Mountain Trail, East Hampton, Conn. 06424

[21] Appl. No.: 476,320

[22] Filed: Feb. 7, 1990

[51] Int. Cl.[5] ..... E04H 4/00; A47K 3/02

[52] U.S. Cl. ..... 4/498; 4/503; 4/580

[58] Field of Search ..... 4/580, 498, 502, 503, 4/499

[56] References Cited

U.S. PATENT DOCUMENTS

| | | | |
|---|---|---|---|
| 2,958,872 | 11/1960 | Meyer | 4/172 |
| 3,072,920 | 1/1963 | Yellott | 4/172 |
| 4,495,977 | 1/1985 | Delluc | 160/70 |
| 4,518,198 | 5/1985 | Daniels | 297/229 |
| 4,606,083 | 8/1986 | Kingston | 4/580 |
| 4,667,352 | 5/1987 | Leister | 4/498 |
| 4,724,558 | 2/1988 | Reiff | 5/455 |

OTHER PUBLICATIONS

MacBall Industries Inc. Dealer Catalog Aug. 1, 1979.

*Primary Examiner*—Henry J. Recla
*Assistant Examiner*—Antoine Gamarra

[57] ABSTRACT

A flexible cover installable on a spa (hot tub) to provide a barrier against upward escape of moisture or heat or chlorine out of the spa. The cover is formed as a three ply laminated sheet that includes an outer canvas layer, an impervious plastic film adhered to the lower face of the canvas layer, and a thermally reflective film adhered to the lower face of the plastic film.

2 Claims, 1 Drawing Sheet

THERMAL COVER FOR A SPA

BACKGROUND AND SUMMARY OF THE INVENTION

This invention relates to a thermal cover for a spa (hot tub). The cover includes a thin insulating blanket laminated to a canvas sheet; in its usage the cover is pulled tightly over the upper rim of a hot tub to form a barrier against upward escape of moisture, or chlorine, or heat. The cover is formed of light weight materials for easy handling and compact storage.

In some respects our thermal cover is similar to a cover shown in U.S. Pat. No. 4,606,083 issued in the name of J. Kingston. However, the Kingston cover is fastened to the spa by means of upstanding pins on the spa rim wall; such upwardly projecting pins could be a safety hazard to persons using the spa. Our thermal cover is fastened to the spa by means of mating snap fasteners carried on flap extensions of the cover and vertical side surfaces of a peripheral flange that surrounds the spa. The snap fasteners are relatively flat structures that are not likely to injure a person if he or she should come into contact with the fastener structures Also, the spa-attached fasteners are located on vertical surfaces of the spa where they are not likely to be struck by a person using the spa.

THE DRAWINGS

DESCRIPTION OF A PREFERRED EMBODIMENT OF THE INVENTION

Figure 5:
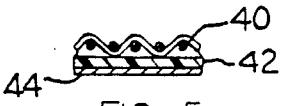
FIG. 5 is a fragmentary sectional view taken through the FIG. 1 cover.
Figure 1:
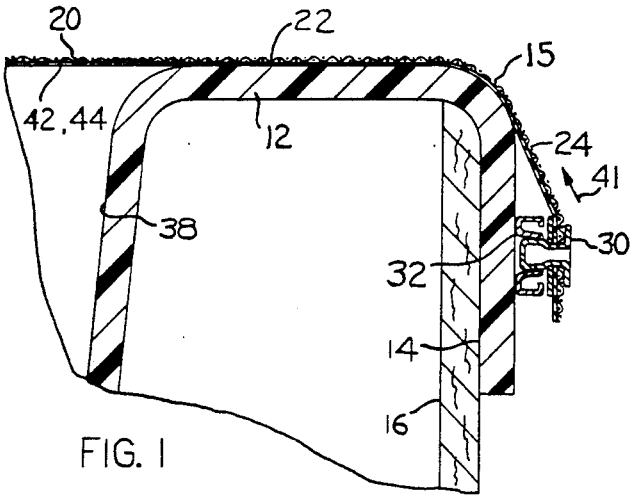
FIG. 1 is a fragmentary sectional view taken through a spa structure having a cover of the present invention installed thereon.

FIG. 1 shows a conventional spa that comprises an upstanding annular water-containment tub wall 10, a horizontal outwardly radiating rim wall 12 extending from the upper edge 11 of wall 10, and an external flange 14 extending downwardly from the outer peripheral edge 15 of rim wall 12. Edges 11 and 15 are curved surfaces forming smooth transitions between the adjacent surfaces.

The tub defined by upstanding annular wall 10 may have various plan configurations, e.g. rectangular, circular, square or octagonal; external flange 14 will extend generally parallel to wall 10. An upstanding decorative skirt wall 16 is located within flange 14; the skirt wall is a wooden structure that extends downwardly to the floor (or cement base) in surrounding relation to the tub defined by wall 10. Water circulation mechanisms, filter mechanisms, and air-injection mechanisms (blower) are located within skirt wall 16. The spa structure shown in the drawings is a conventional structure having a square plan configuration.

Figure 2:
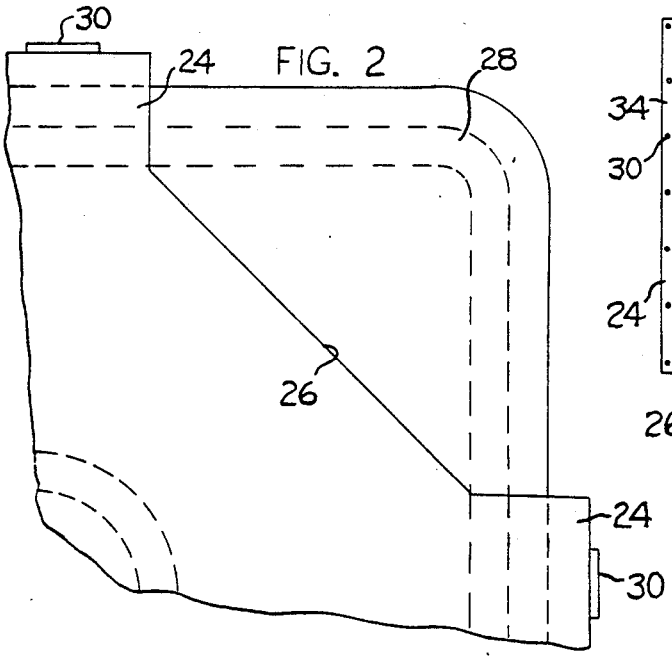
FIG. 2 is a fragmentary top plan view of the structure shown in FIG. 1.
Figure 3:
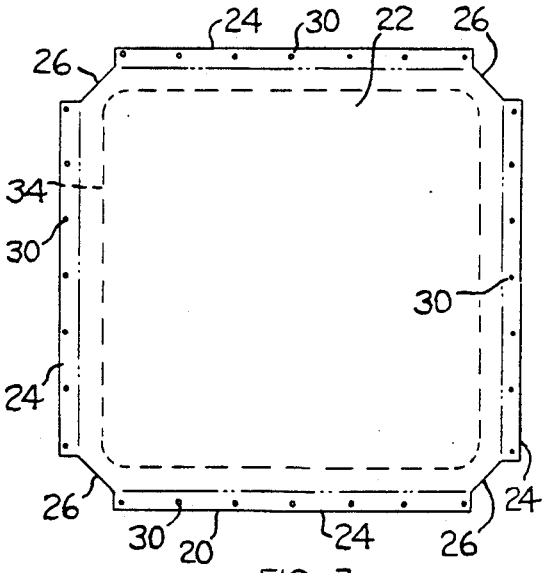
FIG. 3 is a top plan view of the FIG. 1 cover shown on a greatly reduced scale.

Our invention concerns a flexible cover 20 for the spa. The cover comprises a flexible sheet 22 adapted to extend over (across) the space circumscribed by tub wall 10. Outer edge areas of sheet 22 seat against the upper surface of rim wall 12. Four flap structures 24 extend from edge areas of sheet 22. When the cover is centered over the spa, flap structures 24 will be positioned against the curved outer edges 15 and the outer surfaces of external flange 14. Corner areas of sheet 22 are cutaway to form acute angular edge surfaces 26 (FIGS. 2 and 3). This enables the sheet to lie flat on rim wall 12 while avoiding contact with the rounded curved corner surface 28.

The flexible sheet 22 shown in FIG. 3 has four flap structures 24 adapted to seat against the outer surface of spa flange 14. The flap structures are integral extensions of sheet 22. The sheet (and associated flap structures) is preferably formed of a light weight marine canvas layer 40 laminated to a flexible plastic film (layer) 42; the lower face of film 42 is adhesively attached to a thin film of reflective aluminum 44. Film layer 42 may be a polyester plastic having a thickness of about 0.02 inch. Reflective aluminum film 44 is quite thin, on the order of 0.002 inch thick. Snap fasteners 30 are attached to each flap structure 24 near its lower edge. Mating snap fasteners 32 are mounted on flange 14. Each one of fasteners 30 is of the male type; each one of fasteners 32 is of the female type. As shown in FIG. 3, there are seven fasteners on each flap 24; the associated flange 14 will have a corresponding number of mating fasteners.

The spa cover formed by sheet 20 and flap structures 24 will prevent (or retard) upward escape of moisture or chlorine or heat out of the spa. The outer peripheral edge area of sheet 20 will have essentially a sealed fit on the upper surface of rim wall 12. Fasteners 30 and 32 will withstand pulling forces in the arrow 41 direction (upward) that might tend to dislodge the cover from the spa structure; the snap fasteners are relatively thin flat structures so that in practice sheet 20 will be close against the flange 14 surface to withstand upward pull forces. When the cover is detached from the spa structure the exposed fasteners 32 are not likely to be struck by the person using the spa because the fasteners are on a vertical surface; the horizontal rim wall 12 is unobstructed.

Figure 4:
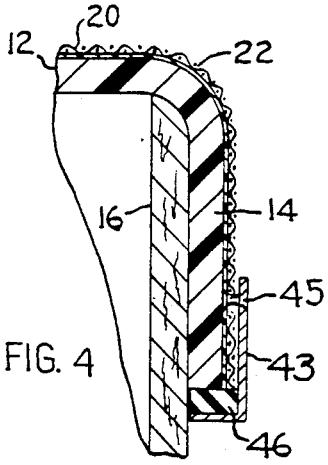
FIG. 4 is a fragmentary sectional view taken in the same direction as FIG. 1, but illustrating a second form of the invention.

FIG. 4 fragmentarily shows a second form of the invention that is similar to that shown in FIGS. 1 through 3 except for the fasteners used to hold the cover on the spa structure. In this case, there are no fasteners on the spa structure. Each fastener is an L-shaped hook element 43 attached to the flap structure by a rivet 45. The horizontal leg of that L is adapted to underlie the lower edge of spa flange 14; a resilient pad 46 may be adhesively attached to the hook element to better grip the edge of flange 14, and also to compensate for small clearances that might otherwise exist due to tolerances in the cover dimensions.

The fastener arrangement of FIG. 4 cannot be used in those situations where the spa is built into a deck structure; the deck structure will then closely underlie the lower edge of spa flange 14, thereby preventing hook elements 43 from engagement with the flange lower edge.

FIGS. 1 through 3 represent a preferred embodiment of the invention. With either form of the invention, the flexible plastic film 42 will form an impervious barrier against the upward escape of moisture or chlorine out of the spa. Reflective film 44 serves as a barrier to heat radiation from the water surface. By cutting away the corners of the covers, as at 26, it is possible to have the cover fit tightly against the upper face of rim wall 12 around the entire perimeter of the spa. The tight sealed fit between the cover and the spa perimeter surface increases the efficiency of the cover for its intended purpose.

We claim:

1. A flexible cover for a spa, wherein the spa comprises an upstanding annular water-containment tub wall, a horizontal outwardly radiating rim wall extending from the upper edge of said tub wall, and an external flange extending downwardly from the outer peripheral edge of said rim wall: said cover comprising a flexible sheet adapted to extend over the tub space and onto the rim wall, a plural number of flap structures extending from outer edge areas of said cover sheet at spaced points therealong, said flap structures being formed as integral extensions of said cover sheet for positionment against the outer edge of said rim wall and the outer surface of said external flange; and a series of fasteners carried on each flap structure for releasable securing the flexible cover on the spa; each flap structure having two side edges extending away from said sheet; edge areas of said sheet between adjacent ones of the flap structures being cut away at acute angles to the side edges of the flap structures so that the cover fits tightly against the upper face of the horizontal rim wall around the entire perimeter of the spa; said flexible sheet and associated flap structures being a three layer laminated sheet structure comprised of canvas, an impervious plastic film adhered to the lower face of the canvas, and a thermally-reflective film adhered to the lower face of the plastic film.

2. The cover of claim 1, wherein said flexible sheet has a rectangular configuration, with the corners of the rectangle being cut away at acute angles to form cutaway sections between the flap structures.

* * * * *